US011312136B2

(12) United States Patent
Irie et al.

(10) Patent No.: US 11,312,136 B2
(45) Date of Patent: Apr. 26, 2022

(54) INK JET HEAD

(71) Applicant: Panasonic Intellectual Property Management Co., Ltd., Osaka (JP)

(72) Inventors: Kazunobu Irie, Hyogo (JP); Hidehiro Yoshida, Osaka (JP); Shuhei Nakatani, Osaka (JP); Futoshi Ohtsuka, Kyoto (JP); Yousuke Toyofuku, Osaka (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 0 days.

(21) Appl. No.: 17/194,416

(22) Filed: Mar. 8, 2021

(65) Prior Publication Data

US 2021/0291521 A1 Sep. 23, 2021

(30) Foreign Application Priority Data

Mar. 23, 2020 (JP) ..... JP2020-051310

(51) Int. Cl.
*B41J 2/14* (2006.01)
*B41J 2/045* (2006.01)
*B41J 2/175* (2006.01)

(52) U.S. Cl.
CPC ..... *B41J 2/14201* (2013.01); *B41J 2/045* (2013.01); *B41J 2/175* (2013.01); *B41J 2202/11* (2013.01); *B41J 2202/12* (2013.01)

(58) Field of Classification Search
CPC ..... B41J 2/175; B41J 2/045; B41J 2/14201; B41J 2/14274; B41J 2202/12; B41J 2202/11
See application file for complete search history.

(56) References Cited

U.S. PATENT DOCUMENTS 6,412,926 B1 7/2002 Okuda
8,845,079 B2 * 9/2014 Ozawa ..... B41J 2/14233 347/65

(Continued)

FOREIGN PATENT DOCUMENTS

JP 2000-211142 8/2000
JP 2007-098806 4/2007

(Continued)

*Primary Examiner* — An H Do
(74) *Attorney, Agent, or Firm* — Greenblum & Bernstein, P.L.C.

(57) ABSTRACT

An ink jet head includes a piezoelectric element that is driven in a d33 mode, a pressure generation chamber in which a pressure is generated by the piezoelectric element, and an individual ink supply flow passage that through which the ink is supplied to the pressure generation chamber. The ink jet head includes an individual ink discharge flow passage that through which the ink is discharged from the pressure generation chamber, and a nozzle that ejects the ink from the pressure generation chamber. In a cross-sectional view in a direction orthogonal to an arrangement direction of the nozzle, inner diameters of the pressure generation chamber, the individual ink supply flow passage, and the individual ink discharge flow passage are shorter on a part close to the nozzle than a part close to the piezoelectric element side. Accordingly, an ink jet head capable of ejecting high-viscosity ink can be provided.

8 Claims, 10 Drawing Sheets

(56) References Cited

U.S. PATENT DOCUMENTS

| | | | | |
|---|---|---|---|---|
| 8,979,245 | B2 * | 3/2015 | Nariai | B41J 2/14233 347/100 |
| 10,000,066 | B2 | 6/2018 | Nakai | |
| 10,668,736 | B2 | 6/2020 | Yamada et al. | |
| 2005/0162483 | A1 | 7/2005 | Katayama | |
| 2010/0091055 | A1 | 4/2010 | Kawakami et al. | |
| 2013/0208059 | A1 | 8/2013 | Arimoto | |
| 2015/0029265 | A1 | 1/2015 | Iwanaga et al. | |
| 2015/0306875 | A1 | 10/2015 | Nishimura et al. | |
| 2016/0082728 | A1 | 3/2016 | Kohda et al. | |
| 2016/0185113 | A1 | 6/2016 | Yoshida et al. | |
| 2017/0197409 | A1 | 7/2017 | Okushima et al. | |
| 2020/0247136 | A1 | 8/2020 | Yamada et al. | |

FOREIGN PATENT DOCUMENTS

| | | |
|---|---|---|
| JP | 2016-187892 | 11/2016 |
| JP | 2017-140826 | 8/2017 |
| JP | 2019-010770 | 1/2019 |

* cited by examiner

INK JET HEAD

BACKGROUND

1. Technical Field

The present disclosure relates to an ink jet head ejecting an ink droplet.

2. Description of the Related Art

In a case of manufacturing an electronic device or an optical device, a method of forming a detailed pattern on a base material has been widely used. As a method of forming the detailed pattern at a low cost, an ink jet method that does not need a printing plate and enables a desired detailed pattern to be printed on an outer surface of the base material by ejecting an ink droplet has drawn attention.

However, in a case of performing printing with a desired material and a film thickness for obtaining characteristics of the device, it is necessary to use high-viscosity (for example, a viscosity exceeding 10 mPa seconds) ink. Therefore, in a case where a general ink jet head for printing a text or a drawing on paper is used, it is generally difficult to eject the high-viscosity ink.

Even in a case of an ink jet head capable of ejecting the high-viscosity ink, a structure formed between nozzles at a time of manufacturing the nozzles varies slightly. Therefore, a pressure applied to the ink significantly varies depending on the viscosity of the ink. Consequently, ejection characteristics of the ink for each nozzle vary, thereby posing a problem of being unable to form a desired printing film.

Regarding the problem, for example, the technology according to Japanese Patent Unexamined Publication No. 2007-98806 (hereinafter, referred to as "Patent Literature 1") has been disclosed. FIG. 7 is a schematic diagram illustrating a cross section of the ink jet head disclosed in Patent Literature 1.

As illustrated in FIG. 7, the ink jet head of Patent Literature 1 constitutes an apparatus that ejects an ink droplet from nozzle 71 by driving piezoelectric element 76. The ink jet head includes common flow passage 68 configured with six sheets of thin plate member 62*a* to thin plate member 62*f* and constricted portion 70 to which the ink is supplied from common flow passage 68. Thin plate member 62*c* is formed as a steel use stainless (SUS) plate and is a bottom plate of constricted portion 70. Thin plate member 62*d* is formed of a resin plate of, for example, polyimide and is a flow passage portion of constricted portion 70.

In the ink jet head, thin plate member 62*d* bonded to thin plate member 62*c* undergoes laser machining using thin plate member 62*c* as a mask. Accordingly, a positional shift between thin plate member 62*c* and thin plate member 62*d* does not occur. Thus, machining accuracy is improved.

However, in a case of the above configuration, a shift in machining or a shift in bonding in a case of bonding thin plate member 62*e* as a ceiling plate to a side opposite to constricted portion 70 is not considered. Therefore, variations in flow passage resistance of constricted portion 70 caused by the shift in machining or the shift in bonding cannot be completely suppressed. In addition, piezoelectric element 76 is driven in a d31 mode. Thus, in a case of using the high-viscosity ink, the ejection characteristics of the ink from nozzle 71 varies noticeably. That is, in the d31 mode (lengthwise expansion and contraction mode), a displacement amount is large, and torque is small. Therefore, displacement may vary due to the variations in flow passage resistance.

SUMMARY

The present disclosure provides an ink jet head capable of ejecting high-viscosity ink without variations between nozzles.

An ink jet head according to one aspect of the present disclosure includes a piezoelectric element that is driven in a d33 mode, a pressure generation chamber that is disposed below the piezoelectric element and in which a pressure is generated by driving the piezoelectric element, and an individual ink supply flow passage that communicates with the pressure generation chamber and through which ink is supplied to the pressure generation chamber. Furthermore, the ink jet head includes an individual ink discharge flow passage that communicates with the pressure generation chamber and through which the ink is discharged from the pressure generation chamber, and a nozzle that is disposed below the pressure generation chamber and ejects the ink from the pressure generation chamber. In a cross-sectional view in a direction orthogonal to an arrangement direction of the nozzle, an inner diameter of each of the pressure generation chamber, the individual ink supply flow passage, and the individual ink discharge flow passage is shorter on the nozzle side than on the piezoelectric element side.

According to the present disclosure, an ink jet head capable of ejecting high-viscosity ink without variations between nozzles can be provided.

DETAILED DESCRIPTION

Hereinafter, exemplary embodiments of the present disclosure will be described with reference to the drawings.

Common constituents in each drawing will be designated by the same reference signs, and descriptions thereof will not be repeated.

Exemplary Embodiment 1

Hereinafter, ink jet head 100 of Exemplary Embodiment 1 of the present disclosure will be described in separate articles using FIG. 1A and FIG. 1B.

Figure 1A:
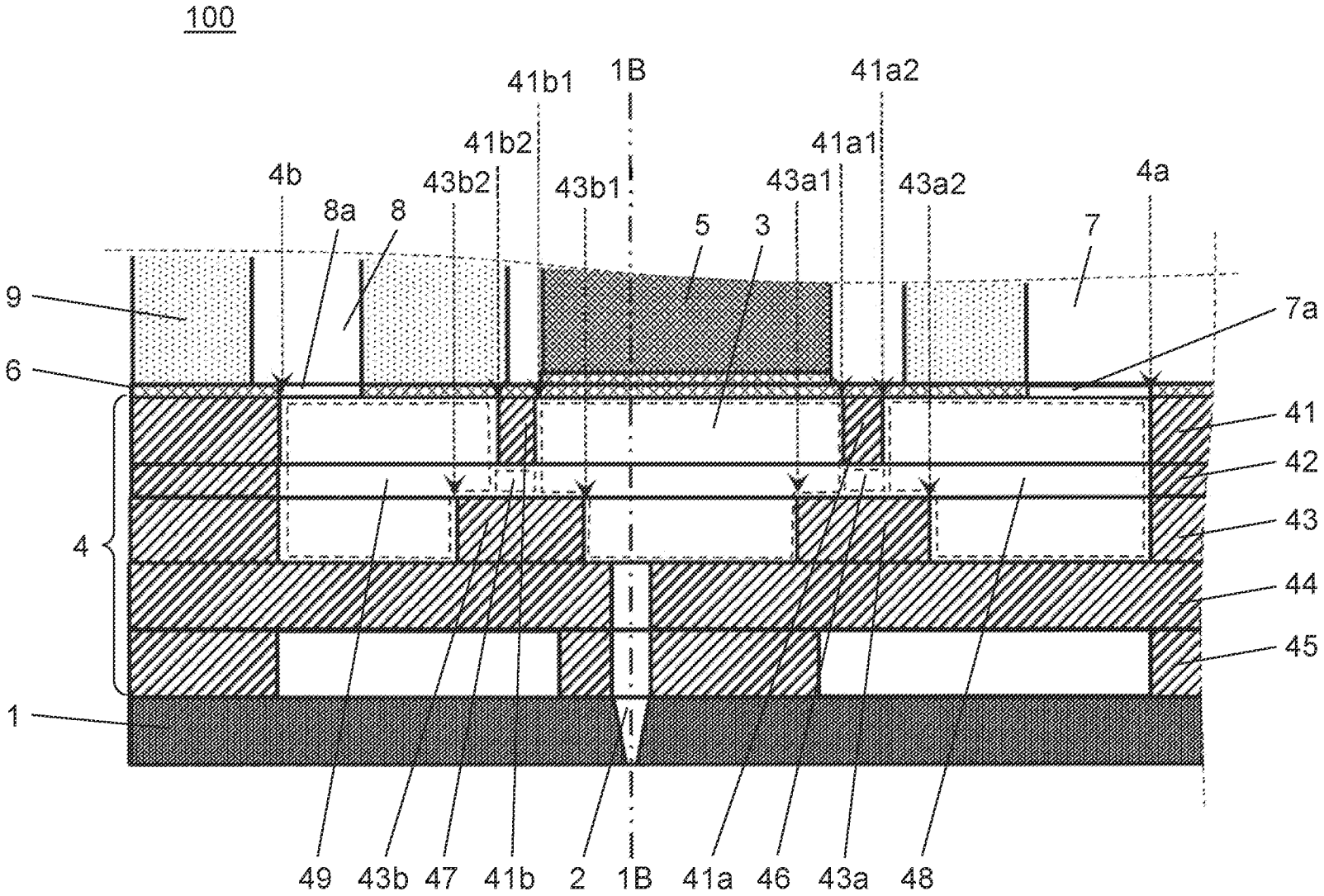
FIG. 1A is a schematic diagram illustrating a cross section of an ink jet head according to Exemplary Embodiment 1 of the present disclosure.

FIG. 1A is a schematic diagram illustrating a cross section of ink jet head 100. FIG. 1B is a 1B-1B cross-sectional view of FIG. 1A.

Ink Jet Head 100

Figure 1B:
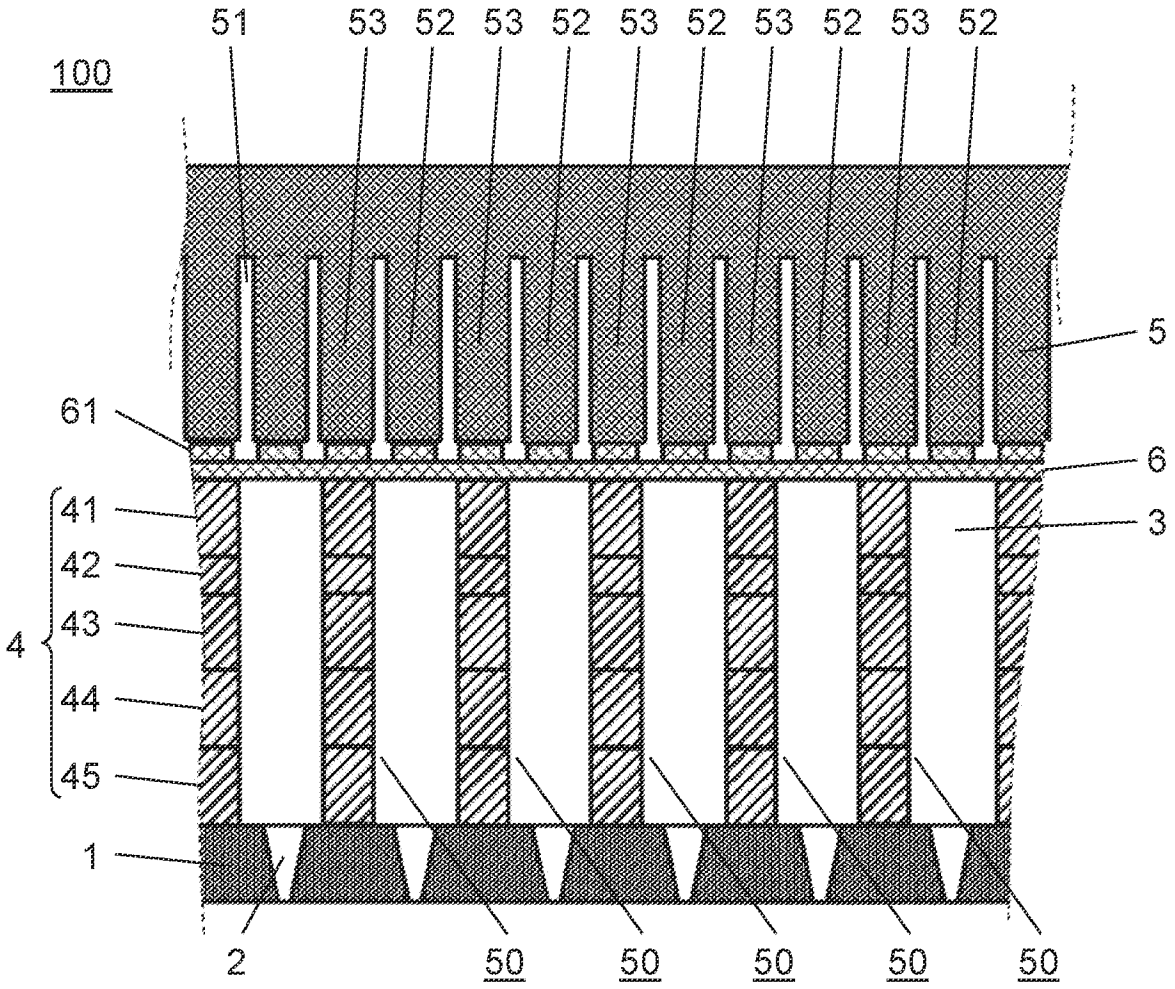
FIG. 1B is an 1B-1B cross-sectional view of FIG. 1A.

As illustrated in FIG. 1A and FIG. 1B, ink jet head 100 of Exemplary Embodiment 1 includes nozzle plate 1, a plurality of nozzles 2, flow passage formation board 4, piezoelectric element 5, vibration plate 6, casing 9, and the like.

Hereinafter, these constituents will be described in further detail.

Nozzle Plate 1 and Nozzle 2

Nozzle plate 1 is a board on which the plurality of nozzles 2 are formed at predetermined intervals. The plurality of nozzles 2 are arranged in a depth direction of FIG. 1A (left-right direction of FIG. 1B).

That is, FIG. 1A illustrates a cross section in a direction orthogonal to an arrangement direction of the plurality of nozzles 2. The same applies to FIG. 1C, FIG. 1D, and FIG. 2 to FIG. 4 described below. That is, a left-right direction of FIG. 1A is a direction orthogonal to the arrangement direction of the plurality of nozzles 2.

For example, laser machining, drill machining, press machining, an etching method, or an electroforming method is exemplified as a method of forming the plurality of nozzles 2 on nozzle plate 1. Considering a degree of freedom and easiness of control in a case of machining a shape of nozzle 2, it is preferable to form nozzle 2 by laser machining.

In addition, nozzle plate 1 is preferably configured to include a water-repellent film formed on an outer surface. The water-repellent film acts to return, into nozzle 2, ink that has slightly exuded on the outer surface of nozzle plate 1 near nozzle 2 in a case where an ink droplet is ejected from nozzle 2.

That is, in a case of a state where ink that has exuded near nozzle 2 remains, a meniscus of an ink outer surface is broken and exerts an adverse effect at a time of ejecting a subsequent ink droplet. Therefore, formation of the water-repellent film on the outer surface of nozzle plate 1 is effective for maintaining stable ejection of the ink droplet from nozzle 2.

As a method of forming the water-repellent film, for example, there is a method of forming the water-repellent film by applying an alkoxysilane solution having fluorine to the nozzle plate and baking the nozzle plate. In addition, a method of forming the water-repellent film based on gas phase polymerization of a monomer having fluorine, or the like is exemplified as the method of forming the water-repellent film. However, the method of forming the water-repellent film is not limited to the above method.

In addition, for example, metal such as stainless steel or a thin plate of a ceramic board can be used as a material of nozzle plate 1. Note that nozzle plate 1 is a member that is disposed closest to a work to be printed (not illustrated) in ink jet head 100. Therefore, in a case of using the ceramic board as nozzle plate 1, there is a concern that the ceramic board cracks when ink jet head 100 comes into contact with the work to be printed for any reason. Therefore, it is preferable to use a thin plate of metal such as stainless steel as the material of nozzle plate 1.

Furthermore, the number of nozzles 2 (hereinafter, referred to as the "number of nozzles") disposed in nozzle plate 1 and an interval (hereinafter, referred to as a "nozzle interval") between adjacent nozzles 2 are decided by a pattern shape of an electronic device or an optical device to be manufactured.

However, in recent years, there has been a tendency to a detailed pattern shape in order to implement high performance of the electronic device or the optical device. Therefore, it is required to increase density of nozzle 2 by increasing the number of nozzles and decreasing the nozzle interval. In a case of increasing the density of nozzle 2, for example, the nozzle interval is significantly decreased to approximately 0.1 mm to 0.2 mm. In addition, a significantly short length of 10 μm to 30 μm is required as a nozzle diameter in accordance with the detailed pattern shape.

Flow Passage Formation Board 4

Flow passage formation board 4 is a board that is disposed at a position corresponding to nozzle 2 and bonded to nozzle plate 1.

As illustrated in FIG. 1B, flow passage formation board 4 includes partition 50 disposed at equal intervals. Partition 50 is configured with first constricted portion formation board 41, constricted flow passage formation board 42, second constricted portion formation board 43, pressure generation chamber bottom surface board 44, pressure generation chamber bottom surface board 45, and the like.

In addition, a space between adjacent partitions 50 functions as pressure generation chamber 3. As illustrated in FIG. 1A, pressure generation chamber 3 communicates with nozzle 2. Furthermore, pressure generation chamber 3 communicates with common ink supply flow passage 7 through ink entrance portion 46. In addition, pressure generation chamber 3 communicates with common ink discharge flow passage 8 through ink exit portion 47.

That is, ink of common ink supply flow passage 7 is supplied into pressure generation chamber 3 through ink entrance portion 46. In addition, ink that is supplied to pressure generation chamber 3 and not ejected from nozzle 2 is discharged to common ink discharge flow passage 8 through ink exit portion 47.

Generally, in a case where an air bubble is mixed in the ink supplied to the pressure generation chamber, the air bubble expands and contracts by a pressure that is generated in the pressure generation chamber by driving the piezoelectric element. Implosion of the air bubble counterbalances a change in pressure generated in the pressure generation chamber and exerts an adverse effect on an ejection operation of the ink droplet. Therefore, in a case of supplying the ink to the ink jet head, it is necessary that entrapment of the air bubble does not occur. However, even so, entrapment of the air bubble slightly occurs in the pressure generation chamber.

Furthermore, particularly, in a case where the ink has a high viscosity, it is unlikely to expect that the air bubble floats up to a liquid surface by buoyancy and naturally disappears. Therefore, an ink jet head of the related art includes a deaeration apparatus that performs deaeration on the supplied ink. However, in a case where the air bubble enters the pressure generation chamber, deaeration by the deaeration apparatus cannot be performed. Therefore, an operation of discharging the ink from the nozzles by a purge operation or the like is generally performed. However, an ink loss occurs due to the purge operation.

Thus, in ink jet head 100 of Exemplary Embodiment 1, pressure generation chamber 3 is disposed to communicate with each of ink entrance portion 46 and ink exit portion 47 as illustrated in FIG. 1A. Accordingly, even when the ejection operation of the ink droplet is not performed, the ink continues flowing in pressure generation chamber 3. Therefore, the air bubble does not stay in pressure generation chamber 3. Consequently, an effect of the air bubble does not occur on the ejection operation of the ink droplet.

That is, in ink jet head 100 of Exemplary Embodiment 1, the ink continuously flows into and out of pressure generation chamber 3 at all times as described above. Accordingly, ink jet head 100 is configured to have an ink circulation structure inside ink jet head 100. For example, by an operation of a pump (not illustrated), the ink circulation structure collects the ink discharged from common ink discharge flow passage 8 and generates a difference in pressure between an ink supply side and an ink discharge side. Accordingly, the ink circulation structure causing the ink to flow and return to common ink supply flow passage 7 again is formed.

The deaeration apparatus may be disposed in the middle of a flow passage of the ink circulation structure. Accordingly, the circulating ink repeatedly undergoes deaeration by the deaeration apparatus. Consequently, even in a case where the air bubble is present in the circulating ink, the air bubble can be more securely removed.

In addition, a flow velocity of the ink circulating in the flow passage of the ink circulation structure is preferably, but is not particularly limited to, a high flow velocity. As the flow velocity is increased, a force that pushes away the air bubble clinging to a wall surface of each flow passage in which the ink flows is increased. Therefore, the air bubble in the ink can be more securely removed.

However, in a case where the flow velocity is excessively increased, it is necessary to further increase the difference in pressure between the ink supply side and the ink discharge side in a case of the high-viscosity ink than in a case of low-viscosity ink. At this point, in a case where a pressure of the ink in pressure generation chamber 3 with respect to nozzle 2 is increased above an external pressure from an outside of nozzle 2, the ink exudes from nozzle 2. Therefore, particularly, the pressure on the ink discharge side has to be a further high negative pressure. Accordingly, conversely, the air bubble is likely to be generated from the ink. Therefore, in a case of using the high-viscosity ink, it is preferable that the flow velocity of the circulating ink is not excessively high. That is, it is preferable to appropriately decide an appropriate value of the flow velocity of the circulating ink in accordance with the viscosity of the ink.

In addition, as illustrated in FIG. 1A and FIG. 1B, flow passage formation board 4 includes first constricted portion formation board 41, constricted flow passage formation board 42, second constricted portion formation board 43, pressure generation chamber bottom surface board 44, pressure generation chamber bottom surface board 45, and the like that are stacked in this order from vibration plate 6 side.

In pressure generation chamber 3, a cross-sectional area of ink entrance portion 46 in an ink flow direction is configured to be smaller than a cross-sectional area of pressure generation chamber 3 in the ink flow direction by constricted portion 41*a* of first constricted portion formation board 41 and constricted portion 43*a* of second constricted portion formation board 43 on common ink supply flow passage 7 side. Constricted portion 41*a* corresponds to one example of a "first constricted portion", and constricted portion 43*a* corresponds to one example of a "second constricted portion".

Similarly, in pressure generation chamber 3, a cross-sectional area of ink exit portion 47 in the ink flow direction is configured to be smaller than the cross-sectional area of pressure generation chamber 3 in the ink flow direction by constricted portion 41*b* of first constricted portion formation board 41 and constricted portion 43*b* of second constricted portion formation board 43 on common ink discharge flow passage 8 side. Constricted portion 41*b* corresponds to one example of a "third constricted portion", and constricted portion 43*b* corresponds to one example of a "fourth constricted portion".

By the above configuration, the pressure generated in pressure generation chambers 3 by driving piezoelectric element 5 is unlikely to leak to common ink supply flow passage 7 and common ink discharge flow passage 8 from pressure generation chamber 3. Therefore, since the pressure can be efficiently transmitted to nozzle 2, an advantage for ejecting the high-viscosity ink is achieved.

That is, in a case where a pressure wave generated in pressure generation chamber 3 leaks to common ink supply flow passage 7 and common ink discharge flow passage 8, the pressure wave is reflected by end portion 4*a* of individual ink supply flow passage 48 or end portion 4*b* of individual ink discharge flow passage 49 and becomes a reflective wave. At this point, there is a concern that the reflected reflective wave returns into pressure generation chamber 3 again. In a case where the reflective wave returns into pressure generation chamber 3, an unnecessary change in pressure occurs in pressure generation chamber 3. The change in pressure causes ejection characteristics of the ink from nozzle 2 to vary. Meanwhile, according to the configuration of Exemplary Embodiment 1, ink entrance portion 46 and ink exit portion 47 each having a small cross-sectional area in the ink flow direction act as resistance to the reflective wave returning into pressure generation chamber 3. Therefore, penetration of the reflective wave into pressure generation chamber 3 is effectively suppressed.

That is, shapes of constricted portion 41*a*, constricted portion 41*b*, constricted portion 43*a*, and constricted portion 43*b* determine flow passage resistance of the constricted portions. Accordingly, a pressure state generated in pressure generation chamber 3 at a time of driving piezoelectric element 5 is determined. Consequently, the ejection characteristics of the ink when the ejection operation of the ink is performed in nozzle 2 are determined. Particularly, in a case where the ink has a high viscosity, a change in pressure loss due to shapes of the flow passages is increased. Therefore, a magnitude of the flow passage resistance is more likely to be affected by the shapes of the constricted portions.

Furthermore, the flow passage resistance is also present for ink flow passages other than the constricted portions. Therefore, in order to circulate the high-viscosity ink, it is preferable that the flow passage resistance of other than the constricted portions is as low as possible. At this point, for common ink supply flow passage 7 and common ink discharge flow passage 8 formed in casing 9 among the ink flow passages, the flow passage resistance can be decreased by increasing cross-sectional areas of common ink supply flow passage 7 and common ink discharge flow passage 8.

However, flow passages of individual ink supply flow passage 48 connecting ink entrance portion 46 to common ink supply flow passage 7, and individual ink discharge flow passage 49 connecting ink exit portion 47 to common ink discharge flow passage 8 are restricted by a pitch of nozzle disposition of the flow passages. Therefore, a large-width flow passage cannot be formed in the depth direction of FIG. 1A.

Thus, in ink jet head 100 of Exemplary Embodiment 1, individual ink supply flow passage 48 and individual ink discharge flow passage 49 are formed across first constricted portion formation board 41, constricted flow passage formation board 42, and second constricted portion formation board 43 as illustrated in FIG. 1A. Accordingly, each of individual ink supply flow passage 48 and individual ink discharge flow passage 49 can have a large cross-sectional area in the ink flow direction. That is, the flow passage resistance in the ink flow direction can be decreased. Consequently, even in a case of using the high-viscosity ink, a decrease in flow velocity of the circulating ink can be suppressed.

First constricted portion formation board 41, constricted flow passage formation board 42, second constricted portion formation board 43, pressure generation chamber bottom surface board 44, and pressure generation chamber bottom surface board 45 constituting flow passage formation board 4 illustrated in FIG. 1A and FIG. 1B can be manufactured using, for example, metal such as steel use stainless (SUS) or silicon.

However, in a case of forming flow passage formation board 4 using silicon, machining accuracy is increased, but a cost is increased, and it is difficult to perform machining on a large area. Meanwhile, in a case of forming flow passage formation board 4 using SUS, low-cost manufacturing can be achieved using laser machining, an etching method, or the like. Furthermore, machining on a large area of flow passage formation board 4 can be easily implemented using the etching method.

In addition, first constricted portion formation board 41 and constricted flow passage formation board 42, constricted flow passage formation board 42 and second constricted portion formation board 43, second constricted portion formation board 43 and pressure generation chamber bottom surface board 44, and pressure generation chamber bottom surface board 44 and pressure generation chamber bottom surface board 45 are bonded by, for example, metal diffusion or an adhesive material. In a case of using the adhesive material, a type of adhesive is not particularly limited. For example, a thermosetting adhesive material, a two-component adhesive material, an ultraviolet-cured adhesive material, an anaerobic adhesive material, or an adhesive material cured by a combined effect thereof can be used.

Piezoelectric Element 5

Piezoelectric element 5 is disposed in a region corresponding to pressure generation chamber 3 of flow passage formation board 4 in casing 9.

Piezoelectric element 5 is formed using the following method. Specifically, first, for example, piezoelectric bodies of lead zirconate titanate in each of which two internal electrodes having comb-tooth shapes meshing with each other are formed are stacked. After the piezoelectric bodies are stacked, an outer surface electrode and an inner surface electrode are formed on both surfaces (left and right sides in FIG. 1A) on which the two internal electrodes are exposed opposite to each other among side surfaces of layers of the piezoelectric bodies. Accordingly, piezoelectric element 5 is formed.

In addition, as illustrated in FIG. 1B, piezoelectric element 5 includes driving channel 52 and non-driving channel 53 that are arranged in a left-right direction of FIG. 1B. Driving channel 52 is disposed at a position corresponding to each pressure generation chamber 3. Non-driving channel 53 is disposed at a position corresponding to each partition 50. Driving channel 52 and non-driving channel 53 are separated by groove 51 formed therebetween. Groove 51 is formed by dicing machining or the like of dividing driving channel 52 and non-driving channel 53 from each other after piezoelectric element 5 is formed as a single body. Adjacent driving channel 52 and non-driving channel 53 are separated and insulated from each other by groove 51.

Furthermore, in piezoelectric element 5, internal electrodes connected to the outer surface electrode and internal electrodes connected to the inner surface electrode are alternately disposed. Therefore, in a case where a difference in electric potential is generated between the outer surface electrode and the inner surface electrode connected to signal cables (not illustrated), piezoelectric element 5 expands and contracts in an up-down direction of FIG. 1B in response to the difference in electric potential, thereby generating a pressure in pressure generation chamber 3. Accordingly, the ink droplet can be ejected from nozzle 2. This is a driving method referred to as a so-called d33 mode. In the d33 mode, the generated pressure is higher than in a d31 mode. Therefore, driving of piezoelectric element 5 in the d33 mode is appropriate for ejecting the high-viscosity ink from nozzle 2.

In addition, the internal electrodes of piezoelectric element 5 are formed to alternately overlap in part with each other for each layer of the stacked piezoelectric bodies. Accordingly, the internal electrodes are disposed to alternately connect the outer surface electrode to the inner surface electrode.

The number of stacked piezoelectric bodies is preferably large because an expansion and contraction amount at a time of applying a voltage is increased. However, in a case where the number of stacked piezoelectric bodies is increased, a thickness of piezoelectric element 5 is increased. Thus, groove 51 has to be deeply machined. Therefore, driving channel 52 and non-driving channel 53 that are cut out by machining groove 51 are likely to collapse. Thus, considering difficulty and the like of machining, it is preferable that the number of stacked piezoelectric bodies is appropriately decided for an appropriate thickness.

Vibration Plate 6

Vibration plate 6 is disposed at a position separating pressure generation chamber 3 and piezoelectric element 5 from each other.

Vibration plate 6 vibrates by a displacement generated in driving channel 52 of piezoelectric element 5 and changes a capacity in pressure generation chamber 3. Accordingly, a pressure is applied to the ink in pressure generation chamber 3, and the ink droplet is ejected from nozzle 2.

At this point, as illustrated in FIG. 1B, vibration plate adhesive layer 61 that is patterned in accordance with a shape of piezoelectric element 5 to adhere thereto may be disposed in vibration plate 6. Accordingly, an area in which vibration plate 6 and piezoelectric element 5 adhere to each other becomes constant. Thus, the ejection characteristics of the ink do not vary for each channel.

Vibration plate 6 is formed using a method of forming by electroforming nickel, a nickel alloy, or the like, a method of forming by performing etching or laser machining on a metal plate of SUS or the like, or a method of performing etching or laser machining on a resin film.

For example, in a case of using resin as a material of vibration plate 6, a surface of vibration plate 6 on pressure generation chamber 3 side is a surface that is in contact with the ink. Therefore, it is preferable to use resin having high chemical resistance as vibration plate 6. For example, the resin having high chemical resistance is exemplified by, but is not particularly limited to, polyamide, polyimide, polyamide-imide, polyetherimide, polyethersulfone, polyetherketone, polyether ether ketone, or fluororesin.

Casing 9

Casing 9 contains nozzle plate 1, flow passage formation board 4, and vibration plate 6 as illustrated in FIG. 1A. That is, casing 9 functions as an attachment unit in a case of attaching ink jet head 100 to an ink jet printer (not illustrated).

Furthermore, casing 9 includes common ink supply flow passage 7 and common ink discharge flow passage 8.

For example, casing 9 is formed using metal such as SUS, resin, ceramic, or a compound material thereof.

In a case of using metal such as SUS as a material of casing 9, casing 9 is formed using the following method of forming. Specifically, for example, casing 9 is formed using a method of forming by mechanical machining such as cutting or electrical discharge machining, a method of stacking etched plate-shaped SUS, a method of forming using a 3D printer, or a method (MIM method) of performing injection molding of metal powder mixed with resin. Furthermore, casing 9 is formed using a compound method or the like of the above methods.

In addition, in a case of using resin as the material of casing 9, for example, casing 9 is formed using injection molding or a 3D printer.

Furthermore, in a case of using ceramic as the material of casing 9, for example, casing 9 is formed using a method of forming by mechanical machining or a method (CIM method) of performing injection molding of ceramic powder mixed with resin.

While the method of forming casing 9 is illustrated above, casing 9 functions as the attachment unit in a case of attaching ink jet head 100 to the ink jet printer as described above. Therefore, considering positioning accuracy, strength, and the like of attachment, casing 9 is more preferably formed by performing mechanical machining on SUS. However, the method of forming casing 9 is not limited to the method.

Effect

In a case where a position of end portion 41*a*1 of constricted portion 41*a* on pressure generation chamber 3 side is compared with a position of end portion 43*a*1 of constricted portion 43*a* on pressure generation chamber 3 side, end portion 41*a*1 is disposed at a position closer to individual ink supply flow passage 48 side than end portion 43*a*1 as illustrated in FIG. 1A.

In addition, in a case where a position of end portion 41*b*1 of constricted portion 41*b* on pressure generation chamber 3 side is compared with a position of end portion 43*b*1 of constricted portion 43*b* on pressure generation chamber 3 side, end portion 41*b*1 is disposed at a position closer to individual ink discharge flow passage 49 side than end portion 43*b*1.

That is, a distance (may be referred to as an "inner diameter") between end portion 43*a*1 and end portion 43*b*1 is shorter than a distance (may be referred to as an "inner diameter") between end portion 41*a*1 and end portion 41*b*1. Accordingly, as illustrated in FIG. 1A, pressure generation chamber 3 has a shape in which an inner diameter on nozzle 2 side is shorter than an inner diameter on vibration plate 6 side (piezoelectric element 5 side), that is, a mortar shape.

Therefore, in a case where piezoelectric element 5 is driven in the d33 mode in which a high pressure can be generated, the pressure generated in pressure generation chamber 3 is concentrated toward nozzle 2 that is positioned on a line extending from the mortar shape. Consequently, the high-viscosity ink can be efficiently ejected from nozzle 2.

In addition, as described above, first constricted portion formation board 41, constricted flow passage formation board 42, second constricted portion formation board 43, pressure generation chamber bottom surface board 44, and pressure generation chamber bottom surface board 45 constituting flow passage formation board 4 are formed by metal diffusion bonding or bonding using an adhesive. In this case, a positional shift (shift in the left-right direction of FIG. 1A) is likely to occur between each board in a case of bonding.

However, in ink jet head 100 of Exemplary Embodiment 1, a positional relationship between end portions of each of constricted portion 41*a* and constricted portion 43*a* is such that end portion 43*a*1, end portion 41*a*1, end portion 41*a*2, and end portion 43*a*2 are disposed in this order from a left side of FIG. 1A. Therefore, even in a case where a positional shift occurs between first constricted portion formation board 41 and second constricted portion formation board 43, a length(width) of ink entrance portion 46 in the ink flow direction is constant. Thus, the flow passage resistance is also almost constant (including constancy).

Similarly, a positional relationship between end portions of each of constricted portion 41*b* and constricted portion 43*b* is such that end portion 43*b*2, end portion 41*b*2, end portion 41*b*1, and end portion 43*b*1 are disposed in this order from the left side of FIG. 1A. Therefore, even in a case where a positional shift occurs between first constricted portion formation board 41 and second constricted portion formation board 43, a length(width) of ink exit portion 47 in the ink flow direction is constant. Thus, the flow passage resistance is also almost constant (including constancy).

Accordingly, variations in pressure on the ink in pressure generation chamber 3 for each channel or the variations for each head are reduced. Consequently, ink jet head 100 having small variations in ejection state of the ink can be implemented.

Hereinafter, a propagation state of the pressure wave leaking from pressure generation chamber 3 at a time of the ejection operation of the ink droplet in ink jet head 100 of Exemplary Embodiment 1 will be described using FIG. 1C.

Figure 1C:
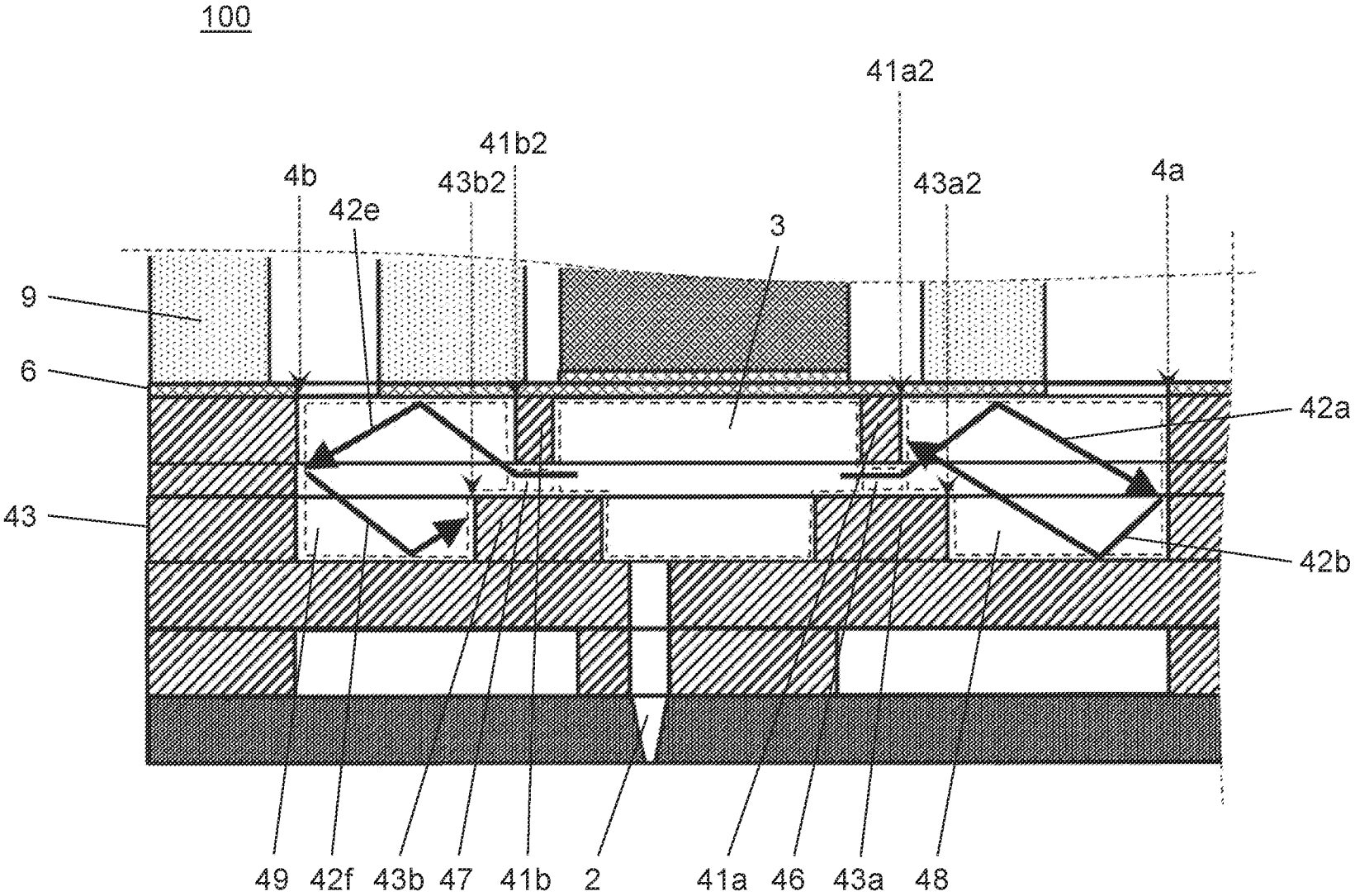
FIG. 1C is a schematic diagram illustrating an advancing direction of a pressure wave leaking from a pressure generation chamber in the ink jet head in FIG. 1A.

FIG. 1C is a schematic diagram illustrating advancing directions of pressure waves 42*a*, 42*b*, 42*e*, and 42*f* leaking from pressure generation chamber 3 in ink jet head 100 in FIG. 1A. Specifically, FIG. 1C illustrates the advancing directions of pressure waves 42*a*, 42*b*, 42*e*, and 42*f* leaking through each of ink entrance portion 46 and ink exit portion 47. A structure of ink jet head 100 illustrated in FIG. 1C is the same as in FIG. 1A.

As illustrated in FIG. 1C, end portion 41*a*2 of constricted portion 41*a* on individual ink supply flow passage 48 side and end portion 43*a*2 of constricted portion 43*a* on individual ink supply flow passage 48 side are positioned in this order from a left side of FIG. 1C. Specifically, end portion 41*a*2 is disposed at a position closer to pressure generation chamber 3 side than end portion 43*a*2.

That is, as illustrated in FIG. 1C, a distance (inner diameter) between end portion 43*a*2 of constricted portion 43*a* and end portion 4*a* of individual ink supply flow passage 48 is shorter than a distance (inner diameter) between end portion 41*a*2 of constricted portion 41*a* and end portion 4*a* of individual ink supply flow passage 48. Accordingly, individual ink supply flow passage 48 is formed to have a shape in which an inner diameter on nozzle 2 side is shorter (smaller) than an inner diameter on vibration plate 6 side (piezoelectric element 5 side).

By the above structure, pressure wave 42*a*, out of the pressure generated in pressure generation chamber 3 at a time of the ejection operation of the ink droplet, that leaks toward individual ink supply flow passage 48 from ink entrance portion 46 first advances in an upward direction of FIG. 1C in a stage after passing through end portion 41*a*2. Pressure wave 42*a* advancing in the upward direction is reflected by vibration plate 6 and then, hits end portion 4*a* of individual ink supply flow passage 48. Then, pressure wave 42*a* is reflected by end portion 4*a* and becomes pressure wave 42*b*. Reflected pressure wave 42*b* is reflected by second constricted portion formation board 43 and advances toward end portion 41*a*2 of constricted portion 41*a*.

That is, pressure wave 42*a* leaking from ink entrance portion 46 does not advance straight and advances in a disturbed manner in individual ink supply flow passage 48. Specifically, for example, in a case where end portion 41*a*2 and end portion 43*a*2 are present at the same position in a left-right direction of a page of FIG. 1C, pressure waves exiting from the pressure generation chamber are diffracted in an up-down symmetric manner. Therefore, the pressure waves that are reflected by end portion 4*a* and return are incident on the constricted portion at the same timing. Meanwhile, as illustrated in FIG. 1C, in a case where end portion 41*a*2 is present on the left side, the pressure waves exiting from pressure generation chamber 3 are first diffracted upward and then downward at a position of end portion 43*a*2 in a non-up-down symmetric manner. Therefore, a timing at which a wave that returns by being reflected by end portion 4*a* returns to the constricted portion is not regular, that is, disturbed. Accordingly, an effect of suppressing a reflective wave that results from a pressure wave perpendicularly hitting end portion 4*a* of individual ink supply flow passage 48 and directly penetrates into ink entrance portion 46 is achieved.

In addition, as illustrated in FIG. 1C, end portion 43*b*2 of constricted portion 43*b* on individual ink discharge flow passage 49 side and end portion 41*b*2 of constricted portion 41*b* on individual ink discharge flow passage 49 side are positioned in this order from the left side of FIG. 1C. Specifically, end portion 41*b*2 is disposed at a position closer to pressure generation chamber 3 side than end portion 43*b*2.

That is, as illustrated in FIG. 1C, a distance (inner diameter) between end portion 43*b*2 of constricted portion 43*b* and end portion 4*b* of individual ink discharge flow passage 49 is shorter than a distance (inner diameter) between end portion 41*b*2 of constricted portion 41*b* and end portion 4*b* of individual ink discharge flow passage 49. Accordingly, individual ink discharge flow passage 49 is formed to have a shape in which an inner diameter on nozzle 2 side is shorter (smaller) than an inner diameter on vibration plate 6 side (piezoelectric element 5 side).

By the above structure, pressure wave 42*e*, out of the pressure generated in pressure generation chamber 3 at a time of the ejection operation of the ink droplet, that leaks toward individual ink discharge flow passage 49 from ink exit portion 47 first advances in the upward direction of FIG. 1C in a stage after passing through end portion 41*b*2. Pressure wave 42*e* advancing in the upward direction is reflected by vibration plate 6 and then, hits end portion 4*b* of individual ink discharge flow passage 49. Then, pressure wave 42*e* is reflected by end portion 4*b* and becomes pressure wave 42*f*. Reflected pressure wave 42*f* is reflected by second constricted portion formation board 43 and advances toward end portion 43*b*2 of constricted portion 41*b*.

That is, pressure wave 42*e* leaking from ink exit portion 47 does not advance straight in individual ink discharge flow passage 49. Pressure wave 42*e* is diffracted in a non-up-down symmetric manner as described above and thus, advances in a disturbed manner. Accordingly, an effect of suppressing a reflective wave that results from a pressure wave perpendicularly hitting end portion 4*b* of individual ink discharge flow passage 49 and directly penetrates into ink exit portion 47 is achieved.

Hereinafter, a reflective wave in an ink jet head as a comparative example of ink jet head 100 will be described using FIG. 1D.

Figure 1D:
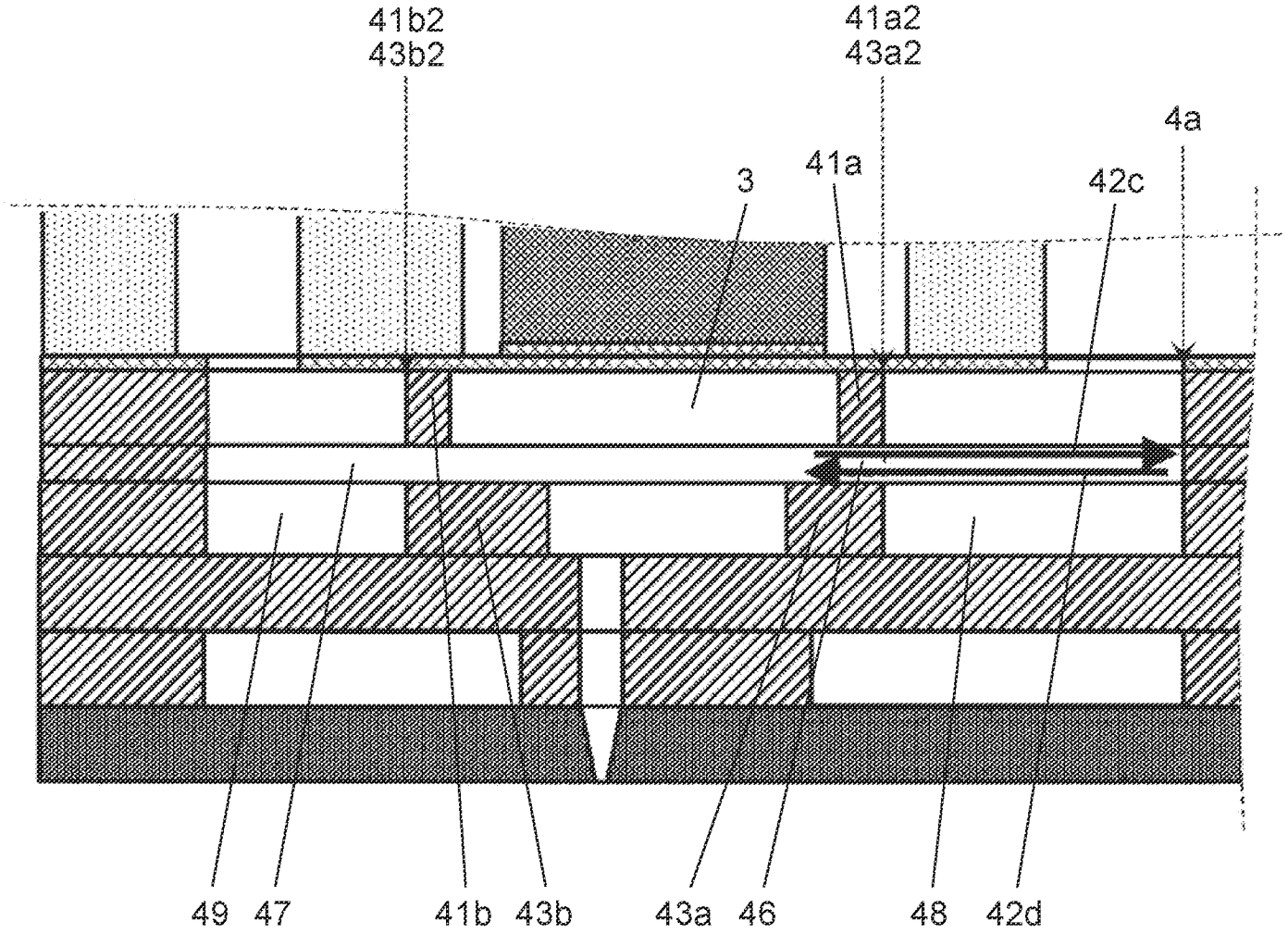
FIG. 1D is a schematic diagram illustrating a cross section of an ink jet head according to a comparative example.

FIG. 1D is a schematic diagram illustrating a cross section of the ink jet head according to the comparative example. Specifically, FIG. 1D illustrates advancing directions of pressure waves 42*c* and 42*d* leaking from pressure generation chamber 3 in the ink jet head of the comparative example.

As illustrated in FIG. 1D, in the ink jet head according to the comparative example, end portion 41*a*2 of constricted portion 41*a* and end portion 43*a*2 of constricted portion 43*a* are present at the same position in a left-right direction of FIG. 1D. In addition, end portion 41*b*2 of constricted portion 41*b* and end portion 43*b*2 of constricted portion 43*b* are present at the same position in the left-right direction of FIG. 1D.

Therefore, in a structure of the ink jet head of the comparative example, pressure wave 42*c*, out of the pressure generated in pressure generation chamber 3 at a time of the ejection operation of the ink droplet, that leaks toward individual ink supply flow passage 48 from ink entrance portion 46 advances straight and perpendicularly hits end portion 4*a* of individual ink supply flow passage 48. Pressure wave 42*c* is reflected by end portion 4*a* and becomes pressure wave 42*d*. Reflected pressure wave 42*d* advances straight and directly penetrates into ink entrance portion 46. Accordingly, an unnecessary change in pressure occurs inside pressure generation chamber 3 due to penetrating pressure wave 42*d*. Therefore, vibration generated by piezoelectric element 5 is affected by the penetrating change in pressure. Consequently, the ejection characteristics of the ink ejected from nozzle 2 vary.

While an advancing direction is not illustrated in FIG. 1D, a pressure wave, out of the pressure generated in pressure generation chamber 3 at a time of the ejection operation of the ink droplet, that leaks toward individual ink discharge flow passage 49 from ink exit portion 47 also advances straight in the same manner as described above, and a reflective wave of the pressure wave directly penetrates into ink exit portion 47. Accordingly, in the same manner as described above, an unnecessary change in pressure occurs inside pressure generation chamber 3, and the ejection characteristics of the ink from nozzle 2 vary.

In addition, in ink jet head 100 of Exemplary Embodiment 1, each of a distance (distance in the left-right direction of FIG. 1A; the same applies below) between end portion 43*a*1 and end portion 41*a*1, a distance between end portion 41*a*2 and end portion 43*a*2, a distance between end portion 43*b*2 and end portion 41*b*2, and a distance between end portion 41*b*1 and end portion 43*b*1 may be greater than or equal to a margin of a positional shift expected at a time of bonding. Specifically, for example, each of the distances is preferably greater than or equal to 30 μm and more preferably greater than or equal to 50 μm.

As described above, ink jet head 100 of Exemplary Embodiment 1 includes piezoelectric element 5 that is driven in the d33 mode, pressure generation chamber 3 that is disposed below piezoelectric element 5 and in which a pressure is generated by driving piezoelectric element 5, and individual ink supply flow passage 48 that communicates with pressure generation chamber 3. Furthermore, ink jet head 100 includes individual ink discharge flow passage 49 that communicates with pressure generation chamber 3, and nozzle 2 that is disposed below pressure generation chamber 3 and ejects the ink in pressure generation chamber 3. In ink jet head 100, an inner diameter of each of pressure generation chamber 3, individual ink supply flow passage 48, and individual ink discharge flow passage 49 is configured to be shorter on nozzle 2 side than on piezoelectric element 5 side in a cross-sectional view in a direction orthogonal to the arrangement direction of nozzle 2.

According to this configuration, the pressure generated in pressure generation chamber 3 is concentrated toward nozzle 2 and advances while an ejection speed is increased. Therefore, the high-viscosity ink can be efficiently ejected from nozzle 2. In addition, pressure waves leaking to individual ink supply flow passage 48 and individual ink discharge flow passage 49 from pressure generation chamber 3 are disturbed in the flow passages. Therefore, returning of the pressure waves into pressure generation chamber 3 is effectively suppressed. Accordingly, generation of an unnecessary change in pressure in pressure generation chamber 3 is suppressed, and occurrence of variations in ejection characteristics of the ink can be suppressed.

Consequently, ink jet head 100 of Exemplary Embodiment 1 can form a desired printing film with high accuracy by ejecting the high-viscosity ink without variations.

Exemplary Embodiment 2

Figure 2:
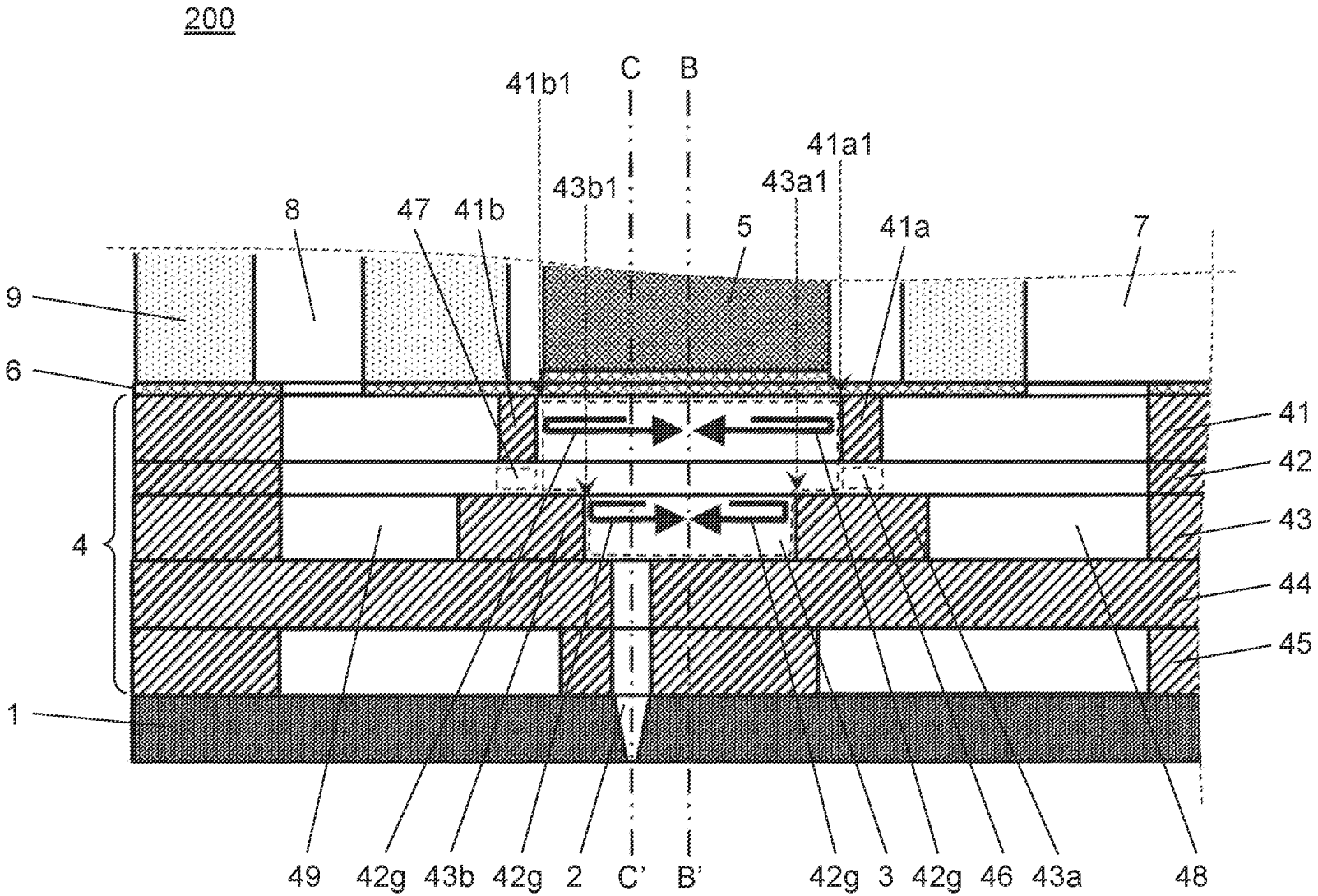
FIG. 2 is a schematic diagram illustrating a cross section of an ink jet head according to Exemplary Embodiment 2 of the present disclosure.

Hereinafter, ink jet head 200 of Exemplary Embodiment 2 of the present disclosure will be described using FIG. 2. FIG. 2 is a schematic diagram illustrating a cross section of ink jet head 200.

As illustrated by arrows in FIG. 2, pressure wave 42*g* generated in pressure generation chamber 3 by driving piezoelectric element 5 first spreads in a left-right symmetric manner in pressure generation chamber 3. Then, pressure wave 42*g* is reflected by end portion 41*a*1 of constricted portion 41*a*, end portion 41*b*1 of constricted portion 41*b*, end portion 43*a*1 of constricted portion 43*a*, and end portion 43*b*1 of constricted portion 43*b*. Reflected pressure wave 42*g* joins at center B-B' of pressure generation chamber 3 (hereinafter, referred to as "center B-B'"). Therefore, in a case where nozzle 2 is disposed at position on center B-B' at which the pressure is concentrated, the ink droplet can be efficiently ejected.

However, in a case where there is a shift in bonding between first constricted portion formation board 41 and second constricted portion formation board 43, a location at which the pressure waves reflected in pressure generation chamber 3 join shifts from center B-B'. Therefore, the ejection characteristics of the ink droplet from nozzle 2 are significantly changed.

Thus, in ink jet head 200 of Exemplary Embodiment 2, position C-C' of nozzle 2 (hereinafter, referred to as "position C-C'") is disposed to be shifted closer to ink exit portion 47 side than center B-B' as illustrated in FIG. 2. Accordingly, variations in ejection characteristics of the ink droplet from nozzle 2 due to a shift in bonding between first constricted portion formation board 41 and second constricted portion formation board 43 can be suppressed. That is, for example, position C-C' corresponds to a center position of an ejection port of nozzle 2.

At this point, in a case where position C-C' of nozzle 2 is not sufficiently separated from center B-B' of pressure generation chamber 3, there is a possibility that position C-C' accidentally matches a position of center B-B' when bonding between first constricted portion formation board 41 and second constricted portion formation board 43 is shifted. Therefore, a distance between position C-C' and center B-B' in a left-right direction of FIG. 2 is preferably configured to be greater than a margin of the shift in bonding. Specifically, for example, the distance between position C-C' and center B-B' is preferably greater than or equal to 30 μm and more preferably greater than or equal to 50 μm.

While a configuration of shifting position C-C' closer to ink exit portion 47 side than center B-B' is illustratively described above, the present disclosure is not limited thereto. For example, position C-C' may be configured to be shifted closer to ink entrance portion 46 side than center B-B'. Even with this configuration, the same effect as described above can be achieved.

Exemplary Embodiment 3

Figure 3:
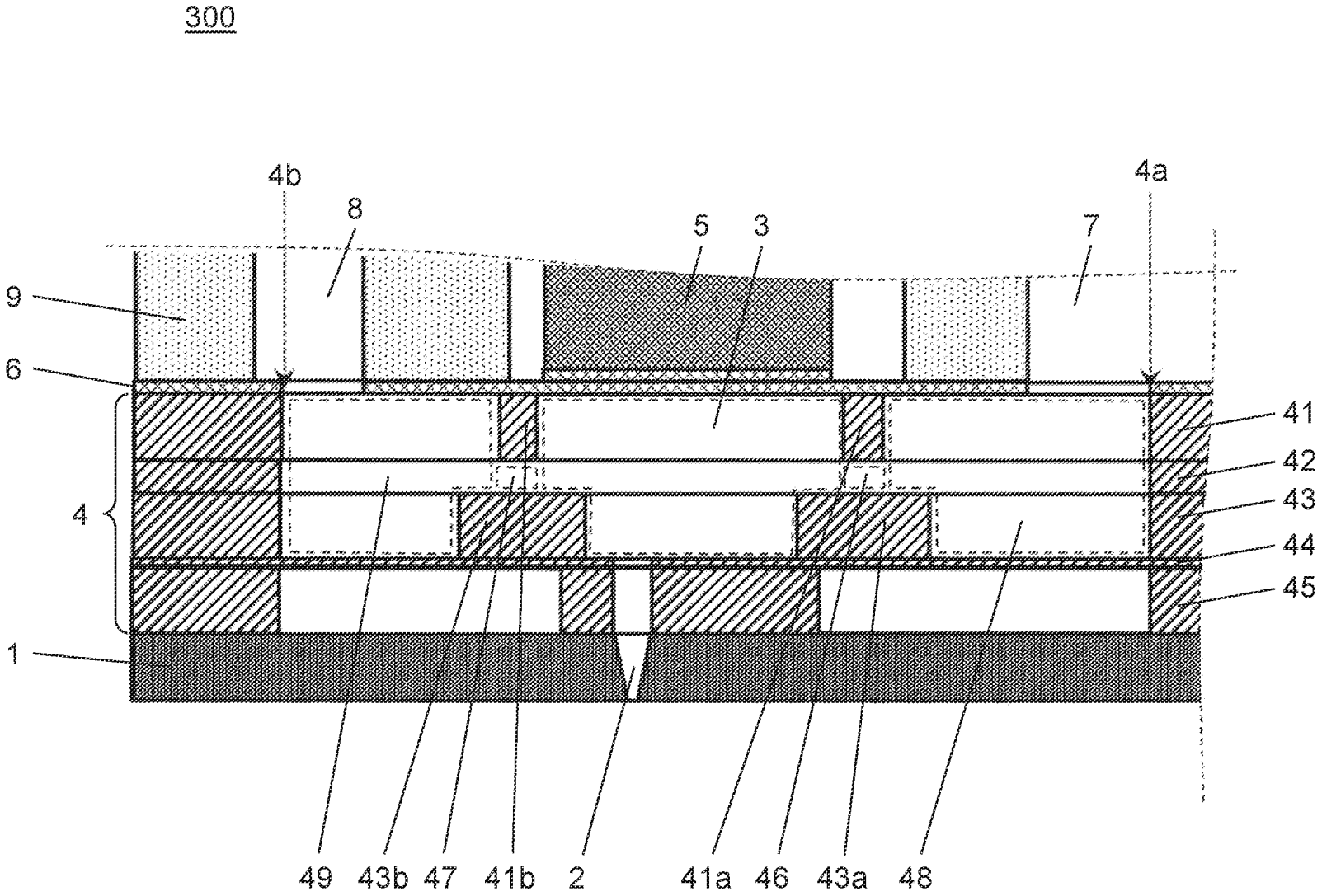
FIG. 3 is a schematic diagram illustrating a cross section of an ink jet head according to Exemplary Embodiment 3 of the present disclosure.

Hereinafter, ink jet head 300 of Exemplary Embodiment 3 of the present disclosure will be described using FIG. 3. FIG. 3 is a schematic diagram illustrating a cross section of ink jet head 300.

As illustrated in FIG. 3, for example, ink jet head 300 of Exemplary Embodiment 3 is different from ink jet head 100 illustrated in FIG. 1A in that a plate thickness of pressure generation chamber bottom surface board 44 is small.

That is, by decreasing the plate thickness of pressure generation chamber bottom surface board 44, a part of pressure generation chamber bottom surface board 44 that corresponds to a position of each of individual ink supply flow passage 48 and individual ink discharge flow passage 49 functions as a damper.

For example, the plate thickness of pressure generation chamber bottom surface board 44 is preferably smaller than or equal to 30 μm and more preferably smaller than or equal to 20 μm. Accordingly, an effective damper action can be achieved.

In addition, a plate thickness of each of first constricted portion formation board 41, constricted flow passage formation board 42, and second constricted portion formation board 43 is preferably 10 μm to 200 μm. This is because in a case where the plate thickness is smaller than 10 μm, each formation board is excessively thin, and thus, it is difficult to handle before bonding. Meanwhile, in a case where the plate thickness is greater than (thicker) than 200 μm, it is necessary to deeply etch each formation board in a case of forming the flow passage in each formation board by etching. Therefore, it is difficult to form a detailed flow passage.

In addition, the plate thickness of each of first constricted portion formation board 41, constricted flow passage formation board 42, and second constricted portion formation board 43 may be the same plate thickness or a plate thickness different from each other, provided that the plate thickness is within a range of the above plate thickness.

In ink jet head 300 having the above structure, pressure waves leaking from pressure generation chamber 3 through each of ink entrance portion 46 and ink exit portion 47 are attenuated in a case where the pressure waves hit the part of pressure generation chamber bottom surface board 44 functioning as the damper. Therefore, the pressure waves leaking out of pressure generation chamber 3 are unlikely to return to pressure generation chamber 3. Consequently, variations in ejection characteristics of the ink ejected from nozzle 2 due to the pressure waves can be more effectively reduced.

A part of pressure generation chamber bottom surface board 44 that corresponds to a position of pressure generation chamber 3 does not function as the damper with respect to the pressure waves. The reason is that pressure generation chamber bottom surface board 45 having a sufficient plate thickness is disposed on a surface of the part on nozzle 2 side (inner surface of a surface on pressure generation chamber 3 side). Therefore, even in a case where the pressure waves are applied, pressure generation chamber bottom surface board 44 to which pressure generation chamber bottom surface board 45 is bonded is unlikely to be displaced.

In addition, while a case where the part corresponding to the position of each of individual ink supply flow passage 48 and individual ink discharge flow passage 49 functions as the damper is illustratively described in Exemplary Embodiment 3, the present disclosure is not limited thereto. For example, a part corresponding to the position of any of individual ink supply flow passage 48 or individual ink discharge flow passage 49 may be configured to function as the damper.

Exemplary Embodiment 4

Hereinafter, an ink jet head of Exemplary Embodiment 4 of the present disclosure will be described.

The ink jet head of Exemplary Embodiment 4 is configured such that a thickness (hereinafter, referred to as a "total thickness") of all of pressure generation chamber bottom surface board 44, pressure generation chamber bottom surface board 45, and nozzle plate 1 in ink jet head 100 to ink jet head 300 according to Exemplary Embodiment 1 to Exemplary Embodiment 3 is 30 μm to 300 μm. The total thickness can be said to be a distance from a bottom surface of pressure generation chamber 3 to a meniscus surface of nozzle 2.

That is, in a case where the total thickness is smaller than 30 μm, it is not possible to obtain rigidity of pressure generation chamber bottom surface board 44 and pressure generation chamber bottom surface board 45 while securing a plate thickness with which the shape of nozzle 2 can be configured. Consequently, the pressure generated in pressure generation chamber 3 is damped and canceled out in pressure generation chamber 3.

Meanwhile, in a case where the total thickness is greater than 300 μm, a distance from pressure generation chamber 3 to the meniscus surface of nozzle 2 is increased. Therefore, in a case where the ink has a high viscosity, the pressure loss is increased, and the ejection characteristics of the ink from nozzle 2 deteriorate.

Therefore, considering the above description, the total thickness is preferably within a range of 30 μm to 300 μm.

Exemplary Embodiment 5

Figure 4:
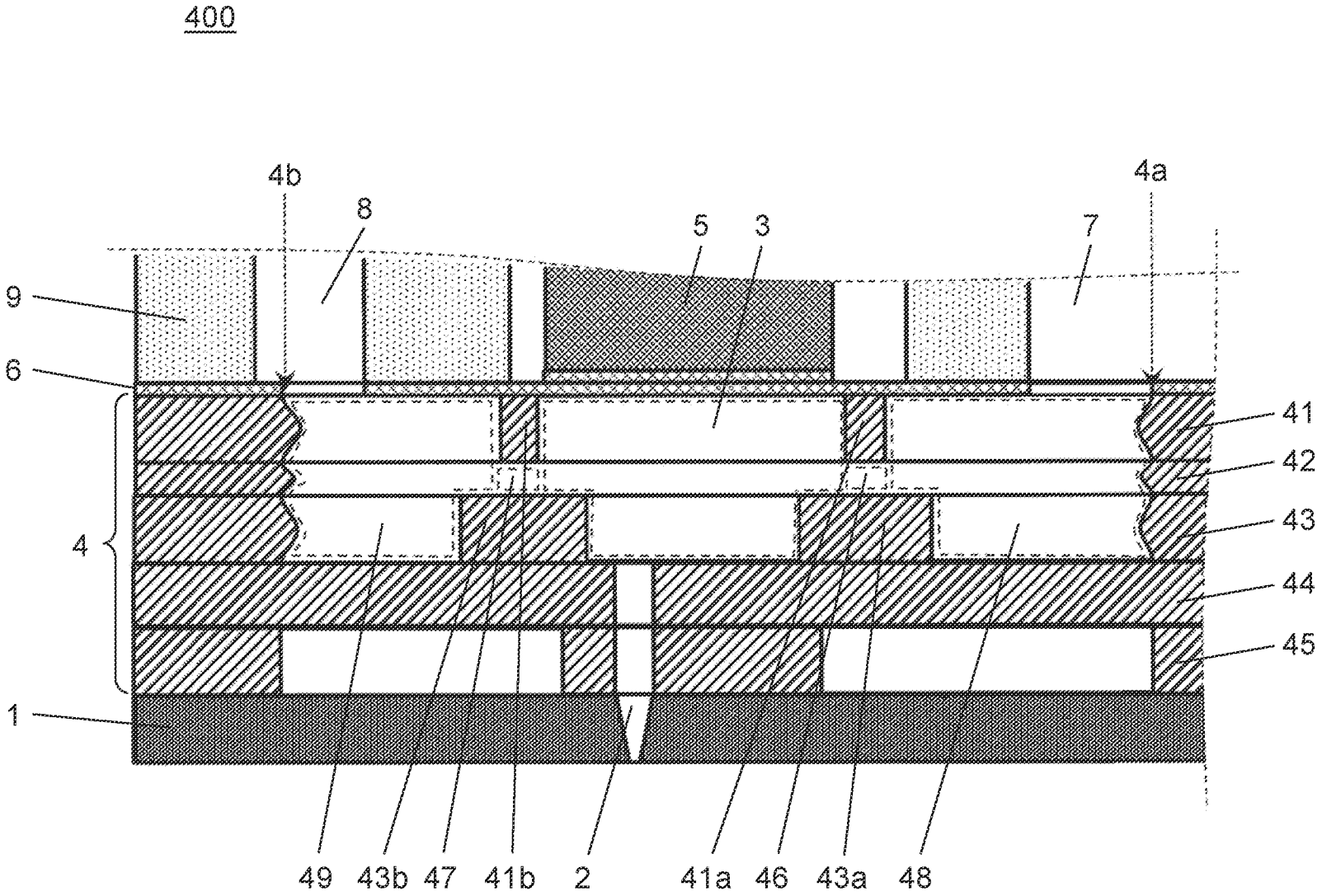
FIG. 4 is a schematic diagram illustrating a cross section of an ink jet head according to Exemplary Embodiment 5 of the present disclosure.

Hereinafter, ink jet head 400 of Exemplary Embodiment 5 of the present disclosure will be described using FIG. 4. FIG. 4 is a schematic diagram illustrating a cross section of ink jet head 400.

As illustrated in FIG. 4, for example, ink jet head 400 of Exemplary Embodiment 5 is different from ink jet head 100 illustrated in FIG. 1A in that roughness is provided in each of end portion 4*a* of individual ink supply flow passage 48 and end portion 4*b* of individual ink discharge flow passage 49.

End portion 4*a* is an end portion that is opposite to an end portion of individual ink supply flow passage 48 on pressure generation chamber 3 side (end portion configured with constricted portion 41*a* and constricted portion 43*a*) (the same applies to other exemplary embodiments). In addition, end portion 4*b* is an end portion that is opposite to an end portion of individual ink discharge flow passage 49 on pressure generation chamber 3 side (end portion configured with constricted portion 41*b* and constricted portion 43*b*) (the same applies to other exemplary embodiments).

In ink jet head 400 having the above structure, pressure waves leaking from pressure generation chamber 3 through each of ink entrance portion 46 and ink exit portion 47 hit each of end portion 4*a* of individual ink supply flow passage 48 and end portion 4*b* of individual ink discharge flow passage 49 that are configured to have roughness. Accordingly, the pressure waves are likely to be disturbed by the roughness of end portion 4*a* and end portion 4*b*. Therefore, the pressure waves are unlikely to return to pressure generation chamber 3. Consequently, variations in ejection characteristics of the ink ejected from nozzle 2 can be more effectively reduced.

While a case of providing roughness in both of end portion 4*a* and end portion 4*b* is illustratively described in Exemplary Embodiment 5, the present disclosure is not limited thereto. For example, roughness may be configured to be provided in any one of end portion 4*a* or end portion 4*b*.

For example, the roughness can be formed by performing wet etching machining on first constricted portion formation board 41, constricted flow passage formation board 42, and second constricted portion formation board 43 that are configured using SUS. Specifically, in a case of double-sided etching, a projection portion is formed in each formation board near a center of the formation board in a depth direction. In addition, in a case of single-sided etching, a projection portion having a tapered shape is formed in each formation board in the depth direction of the formation board.

Each formation board having the projection portion formed using the above method is stacked. Accordingly, as illustrated in FIG. 4, roughness is formed in end portion 4*a* and end portion 4*b*, and the formed roughness functions to disturb the pressure waves.

Exemplary Embodiment 6

Hereinafter, ink jet head 500 of Exemplary Embodiment 6 of the present disclosure will be described using FIG. 5.

Ink jet head 500 of Exemplary Embodiment 6 has the same configuration as any of ink jet head 100 to ink jet head 400 (refer to FIG. 1A, and FIG. 2 to FIG. 4).

Figure 5:
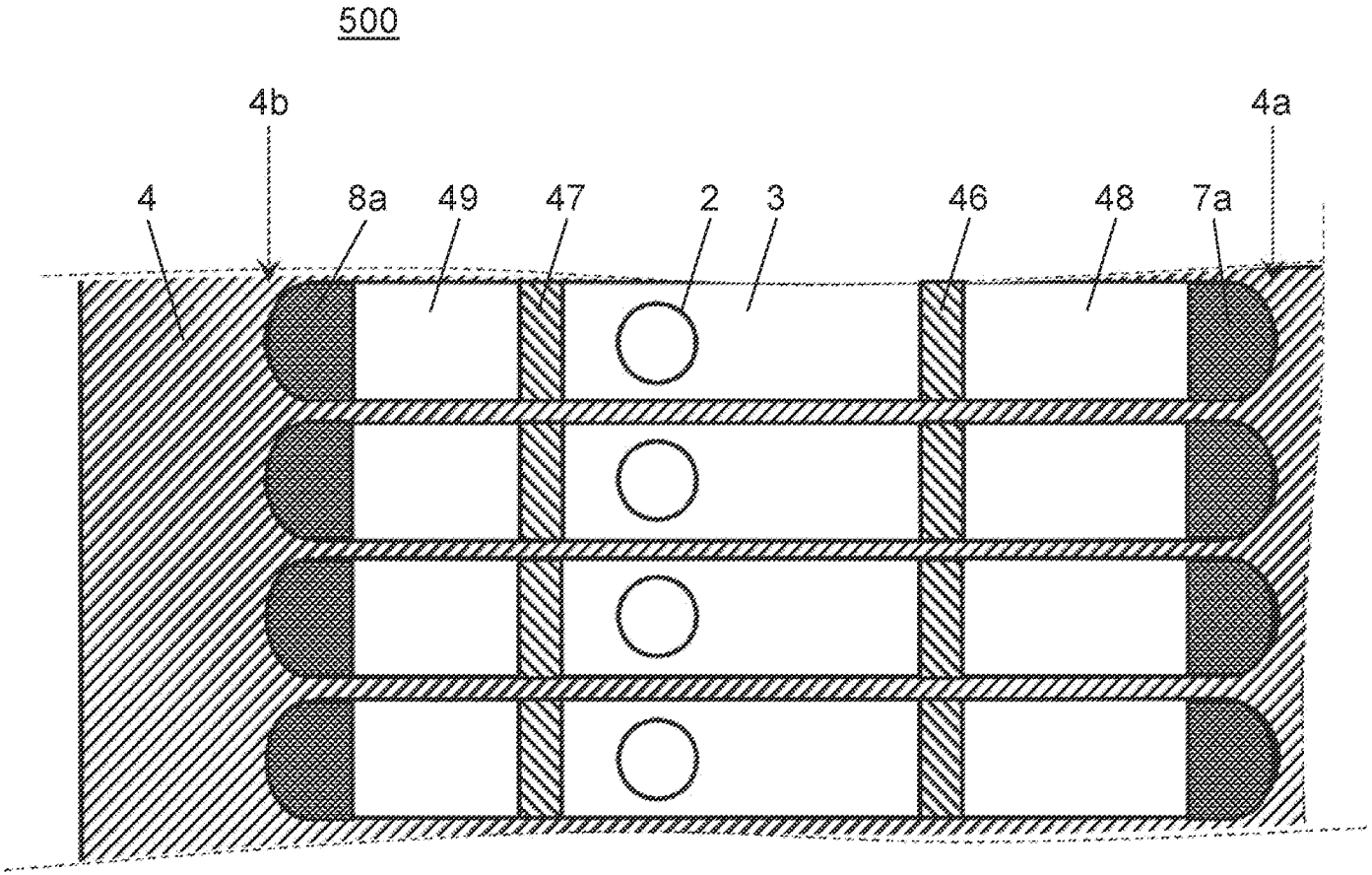
FIG. 5 is a schematic diagram illustrating a state where a flow passage formation board of an ink jet head according to Exemplary Embodiment 6 of the present disclosure is seen directly from above.

FIG. 5 is a schematic diagram illustrating a state where flow passage formation board 4 of ink jet head 500 is seen directly from above. FIG. 5 illustrates ink entrance portion 46 and ink exit portion 47 and thus, does not illustrate constricted portions 41*a* and 41*b*.

That is, FIG. 5 illustrates a top view of nozzle 2, pressure generation chamber 3, flow passage formation board 4, ink entrance portion 46, ink exit portion 47, individual ink supply flow passage 48, individual ink discharge flow passage 49, end portions 4*a* and 4*b*, connecting portion 7*a*, and connecting portion 8*a*.

As illustrated in FIG. 5, in ink jet head 500 of Exemplary Embodiment 6, end portion 4*a* of individual ink supply flow passage 48 and end portion 4*b* of individual ink discharge flow passage 49 seen directly from above are configured to have an arc shape.

In ink jet head 500 having the above structure, pressure waves leaking from pressure generation chamber 3 through each of ink entrance portion 46 and ink exit portion 47 hit each of end portion 4*a* of individual ink supply flow passage 48 and end portion 4*b* of individual ink discharge flow passage 49 that are configured to have an arc shape. Accordingly, the pressure waves are likely to be disturbed by each end portion having an arc shape. Therefore, the pressure waves are unlikely to return to pressure generation chamber 3. Consequently, variations in ejection characteristics of the ink ejected from nozzle 2 are more effectively reduced.

While a case where end portion 4*a* and end portion 4*b* have an arc shape is illustratively described in Exemplary Embodiment 6, the present disclosure is not limited thereto. For example, end portion 4*a* and end portion 4*b* may have a shape other than a linear shape, that is, a non-linear shape.

Note that in a case where a cross-sectional area of connecting portion 7*a* that connects common ink supply flow passage 7 (refer to FIG. 1A, FIG. 2, and FIG. 3) to individual ink supply flow passage 48, and a cross-sectional area of connecting portion 8*a* that connects common ink discharge flow passage 8 (refer to FIG. 1A, FIG. 2, and FIG. 3) to individual ink discharge flow passage 49 are excessively small, the flow passage resistance is increased. Therefore, considering the flow passage resistance, an appropriate shape is appropriately decided as the non-linear shapes of end portion 4*a* and end portion 4*b*.

While a case where both of end portion 4*a* and end portion 4*b* have a non-linear shape (for example, an arc shape) is illustratively described in Exemplary Embodiment 6, any one of end portion 4*a* or end portion 4*b* may have the non-linear shape.

In addition, the non-linear shape is formed using the same method as a method of forming the roughness described in Exemplary Embodiment 5. That is, for example, the non-linear shape can be formed by performing wet etching machining on first constricted portion formation board 41, constricted flow passage formation board 42, and second constricted portion formation board 43 that are configured using SUS.

Exemplary Embodiment 7

Hereinafter, ink jet head 600 of Exemplary Embodiment 7 of the present disclosure will be described using FIG. 6.

Ink jet head 600 of Exemplary Embodiment 7 has the same configuration as ink jet head 500 of Exemplary Embodiment 6.

Figure 6:
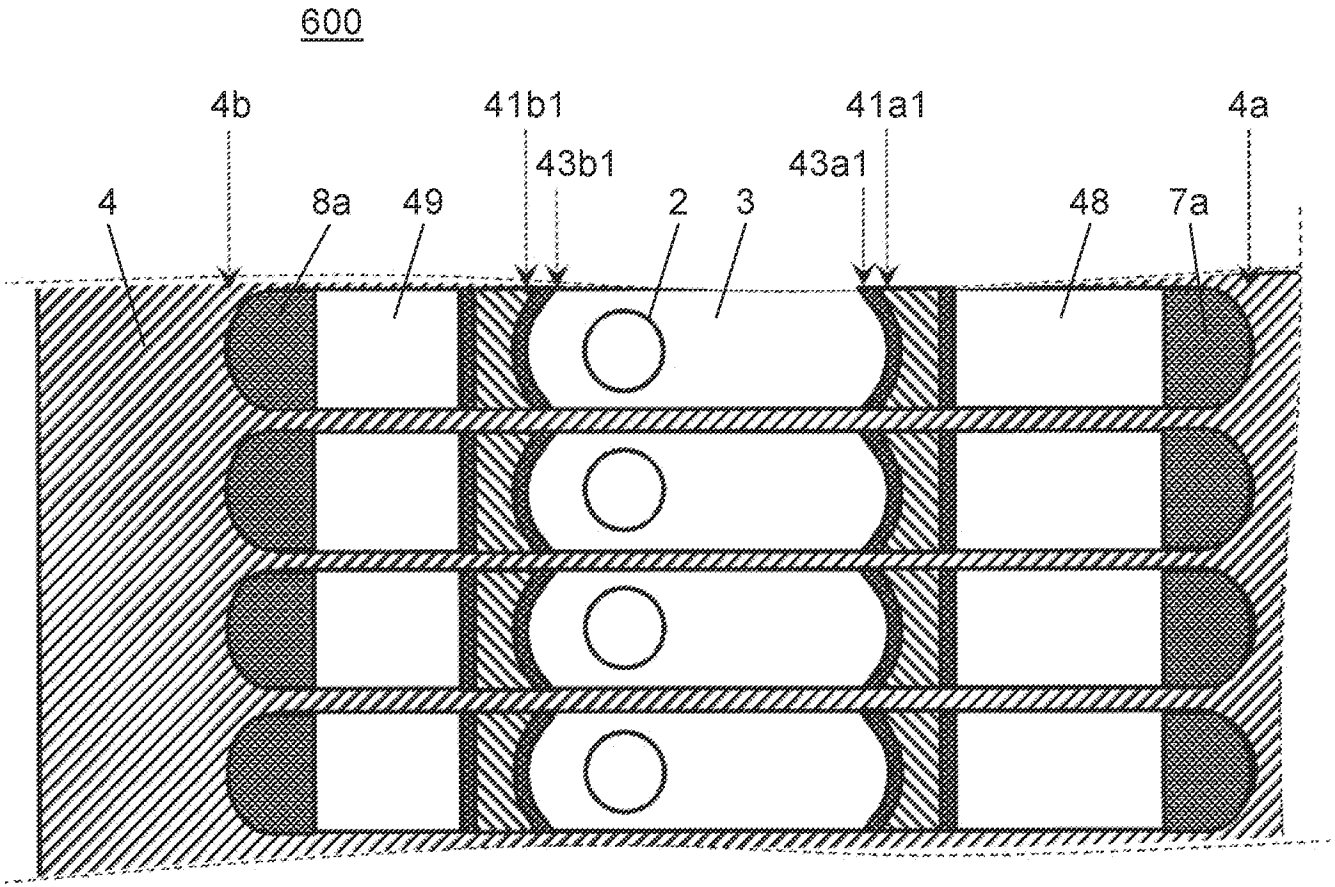
FIG. 6 is a schematic diagram illustrating a state where a flow passage formation board of an ink jet head according to Exemplary Embodiment 7 of the present disclosure is seen directly from above.
Figure 7:
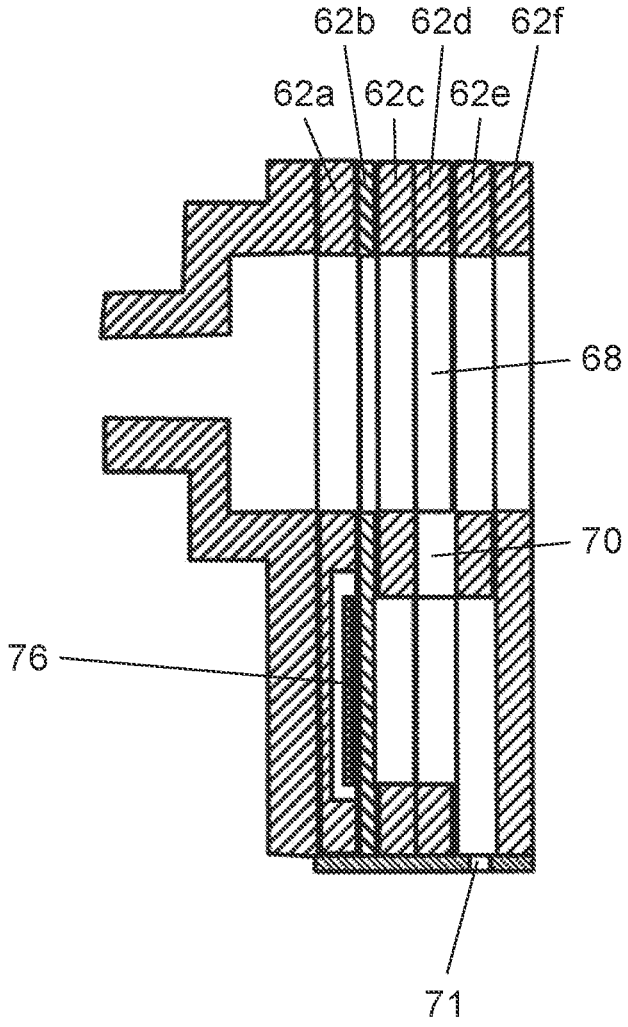
FIG. 7 is a schematic diagram illustrating a cross section of the ink jet head of Patent Literature 1.

FIG. 6 is a schematic diagram illustrating a state where flow passage formation board 4 of ink jet head 600 is seen directly from above. FIG. 6 illustrates ink entrance portion 46 and ink exit portion 47 and thus, does not illustrate constricted portions 41*a* and 41*b*.

That is, FIG. 6 illustrates a top view of nozzle 2, pressure generation chamber 3, flow passage formation board 4, ink entrance portion 46, ink exit portion 47, individual ink supply flow passage 48, individual ink discharge flow passage 49, end portions 4*a*, 4*b*, 41*a*1, 41*b*1, 43*a*1, and 43*b*1, and connecting portions 7*a* and 8*a*.

As illustrated in FIG. 6, in ink jet head 600 of Exemplary Embodiment 7, end portion 41*a*1, end portion 41*b*1, end portion 43*a*1, and end portion 43*b*1 seen directly from above are configured to have an arc shape.

End portion 41*a*1 illustrated in FIG. 6 is an end portion of constricted portion 41*a*, illustrated in FIG. 1A, on pressure generation chamber 3 side. End portion 41*b*1 illustrated in FIG. 6 is an end portion of constricted portion 41*b*, illustrated in FIG. 1A, on pressure generation chamber 3 side. End portion 43*a*1 illustrated in FIG. 6 is an end portion of constricted portion 43*a*, illustrated in FIG. 1A, on pressure generation chamber 3 side. End portion 43*b*1 illustrated in FIG. 6 is an end portion of constricted portion 43*b*, illustrated in FIG. 1A, on pressure generation chamber 3 side.

That is, end portion 41*a*1, end portion 41*b*1, end portion 43*a*1, and end portion 43*b*1 illustrated in FIG. 6 correspond to one example of an "inner wall of pressure generation chamber 3".

In ink jet head 600 having the above structure, pressure waves in pressure generation chamber 3 hit each of end portion 41*a*1, end portion 41*b*1, end portion 43*a*1, and end portion 43*b*1 that are configured to have an arc shape. Accordingly, the pressure waves are likely to be disturbed by each end portion having an arc shape. Therefore, it is possible to smooth a pressure distribution at a location at which reflective waves join, while avoiding concentration of the pressure. Consequently, variations in ejection characteristics of the ink ejected from nozzle 2 due to a shift in bonding between first constricted portion formation board 41 and second constricted portion formation board 43 can be further suppressed.

While a case where end portion 41*a*1, end portion 41*b*1, end portion 43*a*1, and end portion 43*b*1 have an arc shape is illustratively described in Exemplary Embodiment 7, the present disclosure is not limited thereto. For example, end portion 41*a*1, end portion 41*b*1, end portion 43*a*1, and end portion 43*b*1 may have a shape other than a linear shape, that is, a non-linear shape.

In addition, while a case where all of end portion 41*a*1, end portion 41*b*1, end portion 43*a*1, and end portion 43*b*1 have a non-linear shape (for example, an arc shape) is illustratively described in Exemplary Embodiment 7, the present disclosure is not limited thereto. For example, only end portion 41*a*1 and end portion 43*a*1 may have a non-linear shape, or only end portion 41*b*1 and end portion 43*b*1 may have a non-linear shape.

In addition, the non-linear shape is formed using the same method as a method of forming the roughness described in Exemplary Embodiment 5. That is, for example, the non-linear shape can be formed by performing wet etching machining on first constricted portion formation board 41, constricted flow passage formation board 42, and second constricted portion formation board 43 that are configured using SUS.

Each exemplary embodiment of the present disclosure is described above. The present disclosure is not limited to the above description, and various modifications can be carried out without departing from a gist of the present disclosure.

What is claimed is:

1. An ink jet head comprising:

a piezoelectric element that is driven in a d33 mode;

a pressure generation chamber that is disposed below the piezoelectric element and in which a pressure is generated by driving the piezoelectric element;

an individual ink supply flow passage that communicates with the pressure generation chamber and through which ink is supplied to the pressure generation chamber;

an individual ink discharge flow passage that communicates with the pressure generation chamber and through which the ink is discharged from the pressure generation chamber; and a nozzle that is disposed below the pressure generation chamber and ejects the ink from the pressure generation chamber, wherein in a cross-sectional view in a direction orthogonal to an arrangement direction of the nozzle, an inner diameter of each of the pressure generation chamber, the individual ink supply flow passage, and the individual ink discharge flow passage is shorter on the nozzle side than on the piezoelectric element side.

2. The ink jet head of claim 1, further comprising:

a first constricted portion that is disposed on the piezoelectric element side for forming an ink entrance portion causing the pressure generation chamber to communicate with the individual ink supply flow passage;

a second constricted portion that is disposed on the nozzle side for forming the ink entrance portion;

a third constricted portion that is disposed on the piezoelectric element side for forming an ink exit portion causing the pressure generation chamber to communicate with the individual ink discharge flow passage; and a fourth constricted portion that is disposed on the nozzle side for forming the ink exit portion, wherein in the cross-sectional view in the direction orthogonal to the arrangement direction of the nozzle, an end portion of the first constricted portion on the pressure generation chamber side is positioned closer to the individual ink supply flow passage side than an end portion of the second constricted portion on the pressure generation chamber side, an end portion of the first constricted portion on the individual ink supply flow passage side is positioned closer to the pressure generation chamber side than an end portion of the second constricted portion on the individual ink supply flow passage side, an end portion of the third constricted portion on the pressure generation chamber side is positioned closer to the individual ink discharge flow passage side than an end portion of the fourth constricted portion on the pressure generation chamber side, and an end portion of the third constricted portion on the individual ink discharge flow passage side is positioned closer to the pressure generation chamber side than an end portion of the fourth constricted portion on the individual ink discharge flow passage side.

3. The ink jet head of claim 1, wherein in the cross-sectional view in the direction orthogonal to the arrangement direction of the nozzle, a position of the nozzle is disposed to be shifted to any of the individual ink supply flow passage side or the individual ink discharge flow passage side with respect to a center of the piezoelectric element.

4. The ink jet head of claim 1, wherein a part of a bottom surface of at least one of the individual ink supply flow passage and the individual ink discharge flow passage has a damper function of attenuating a pressure wave.

5. The ink jet head of claim 1, wherein a distance from a bottom surface of the pressure generation chamber to a meniscus surface of the nozzle is 30 μm to 300 μm.

6. The ink jet head of claim 1, wherein in the cross-sectional view in the direction orthogonal to the arrangement direction of the nozzle, roughness is provided in at least one of an end portion of the individual ink supply flow passage opposite to an end portion on the pressure generation chamber side, and an end portion of the individual ink discharge flow passage opposite to an end portion on the pressure generation chamber side.

7. The ink jet head of claim 1, wherein in a top view of the individual ink supply flow passage and the individual ink discharge flow passage, at least one of an end portion of the individual ink supply flow passage opposite to an end portion on the pressure generation chamber side, and an end portion of the individual ink discharge flow passage opposite to an end portion on the pressure generation chamber side has a non-linear shape.

8. The ink jet head of claim 1, wherein in a top view of the pressure generation chamber, at least a part of an inner wall of the pressure generation chamber has a non-linear shape.

* * * * *